US009255315B2

(12) United States Patent
Kröpfl et al.

(10) Patent No.: US 9,255,315 B2
(45) Date of Patent: Feb. 9, 2016

(54) AL-MG ALLOY PRODUCT SUITABLE FOR ARMOUR PLATE APPLICATIONS

(71) Applicant: ALERIS ALUMINUM KOBLENZ GMBH, Koblenz (DE)

(72) Inventors: Ingo Günther Kröpfl, Polch (DE); Claus Jürgen Moritz, Koblenz (DE); Stefan Moldenhauer, Bad Ems (DE)

(73) Assignee: ALERIS ALUMINUM KOBLENZ GMBH, Koblenz (DE)

( * ) Notice: Subject to any disclaimer, the term of this patent is extended or adjusted under 35 U.S.C. 154(b) by 170 days.

(21) Appl. No.: 14/269,562

(22) Filed: May 5, 2014

(65) Prior Publication Data

US 2015/0284831 A1 Oct. 8, 2015

Related U.S. Application Data

(63) Continuation of application No. 12/029,398, filed on Feb. 11, 2008, now abandoned.

(60) Provisional application No. 60/889,386, filed on Feb. 12, 2007.

(51) Int. Cl.
*C22F 1/047* (2006.01)
*C22C 1/06* (2006.01)
(Continued)

(52) U.S. Cl.
CPC ..... *C22F 1/047* (2013.01); *B22D 21/007* (2013.01); *C22C 1/06* (2013.01); *C22C 21/06* (2013.01); *C22C 21/08* (2013.01); *C22F 1/04* (2013.01); *F41H 5/023* (2013.01)

(58) Field of Classification Search
IPC ..... C22F 1/047
See application file for complete search history.

(56) References Cited

U.S. PATENT DOCUMENTS 3,851,787 A * 12/1974 Setzer et al. ..... 220/273
4,284,437 A 8/1981 Baba et al.
(Continued)

FOREIGN PATENT DOCUMENTS

EP 0 385 257 A1 9/1990
EP 0 799 900 A1 10/1997
(Continued)

OTHER PUBLICATIONS

Moldenhauer et al., Alustar Alloy: A Potential Candidate Aluminum Material for Naval Ship Building, Naval Platform Technology Seminar, Singapore (May 2001).

*Primary Examiner* — Roy King
*Assistant Examiner* — Janelle Morillo
(74) *Attorney, Agent, or Firm* — Novak Druce Connolly Bove + Quigg LLP

(57) ABSTRACT

Aluminum alloy plate having improved resistance against incoming kinetic energy projectiles, the plate having a gauge of 10 mm or more and the aluminum alloy having a chemical composition including, in weight percent: Mg 4.0 to 6.0, Mn 0.2 to 1.4, Zn 0.9 max., Zr<0.3, Cr<0.3, Sc≤0.5, Ti≤0.3, Fe<0.5, Si<0.45, Ag<0.4, Cu<0.25, other elements and unavoidable impurities each <0.05, total <0.20, balance aluminum, and wherein the alloy plate is obtained by a manufacturing process including casting, preheating and/or homogenization, hot rolling, a first cold working operation, an annealing treatment at a temperature of less than 350° C., followed by a second cold working operation.

24 Claims, 1 Drawing Sheet

(51) Int. Cl.

| | |
|---|---|
| ***C22C 21/06*** | (2006.01) |
| ***C22F 1/04*** | (2006.01) |
| ***B22D 21/00*** | (2006.01) |
| ***C22C 21/08*** | (2006.01) |
| ***F41H 5/02*** | (2006.01) |

(56) References Cited

U.S. PATENT DOCUMENTS

| | | | | |
|---|---|---|---|---|
| 4,469,537 | A | | 9/1984 | Ashton et al. |
| 4,626,294 | A | | 12/1986 | Sanders, Jr. |
| 4,968,356 | A | | 11/1990 | Tanaka et al. |
| 5,605,586 | A | * | 2/1997 | Bekki et al. ..... 148/549 |
| 5,624,632 | A | | 4/1997 | Baumann et al. |
| 6,238,495 | B1 | | 5/2001 | Haszler et al. |
| 6,342,113 | B2 | | 1/2002 | Haszler et al. |
| 6,416,884 | B1 | | 7/2002 | Haszler et al. |
| 6,695,935 | B1 | | 2/2004 | Haszler et al. |
| 6,848,233 | B1 | | 2/2005 | Haszler et al. |
| 2001/0025675 | A1 | | 10/2001 | Haszler et al. |

FOREIGN PATENT DOCUMENTS

| | | | |
|---|---|---|---|
| RU | 2268319 | C2 | 5/2004 |
| RU | 2003122119 | A | 3/2005 |
| RU | 2280705 | C2 | 7/2006 |
| WO | 9526420 | A1 | 10/1995 |
| WO | 2007/115617 | A1 | 10/2007 |

* cited by examiner

AL-MG ALLOY PRODUCT SUITABLE FOR ARMOUR PLATE APPLICATIONS

CROSS-REFERENCE TO RELATED APPLICATION

This is a continuation of U.S. patent application Ser. No. 12/029,398, filed 11 Feb. 2008, pending, which claims the benefit of U.S. provisional application No. 60/889,386, filed Feb. 12, 2007, incorporated herein by reference.

FIELD OF THE INVENTION

This invention pertains to an aluminum alloy plate product having a gauge of 10 mm or more. More particularly, this invention pertains to aluminum-magnesium alloys that are suitable for armour plate, yet have improved performance properties, particularly improved resistance against incoming kinetic energy projectiles in combination with an improved formability.

BACKGROUND OF THE INVENTION

As will be appreciated herein below, except as otherwise indicated, alloy designations and temper designations refer to the Aluminum Association designations in Aluminum Standards and Data and the Registration Records, as published by the Aluminum Association.

For any description of alloy compositions or preferred alloy compositions, all references to percentages are by weight percent unless otherwise indicated.

Because of their light weight, aluminum alloys have found wide use in military applications, including military vehicles such as personnel carriers. The light weight of aluminum allows for improved performance and ease of transporting equipment, including air transport of military vehicles. In some vehicles it is advisable to provide shielding or protection against assault, by providing armour plate to protect the occupants of the vehicle. Aluminum has enjoyed substantial use as armour plate, and there are a number of armour plate specifications for the use of different aluminum alloys.

The most relevant requirements for aluminum alloy armour plate are resistance to projectiles, good corrosion resistance, and in some applications, good weldability. Ballistic tests are often conducted with armour piercing ("AP") projectiles such as the 7.62 mm AP M2 and with fragment simulating projectiles ("FSP") such as the common 20 mm projectile. Aluminum alloys which satisfy all the requirements for armour plate are desirable, and these desires have been met to varying degrees. Aluminum alloys AA5083 and AA5456 are covered in the U.S. Military Specification for armour plate MIL-DTL-46027J (September 1998), and the alloy AA7039 is covered in the U.S. Military Specification MIL-DTL-46063H (September 1998). It is generally recognized that for many applications the alloy AA7039 armour plate is better than AA5083 and AA5456 armour plate, although the advantage is more for armour piercing ballistic performance and less so for fragment simulation performance, at least according to the military specifications. However, the alloy AA7039 can present corrosion or stress corrosion problems to a much greater degree than AA5083 and AA5456. The alloy AA7039 is very difficult to weld. The AA7039 alloy when used for armour plate applications is commonly in a T6 temper and the AA5083 and AA5456 alloys when used for armour plate applications is used in the H131 temper.

The compositional ranges for AA5083 are, in weight percent:

Mg 4.0-4.9
Mn 0.40-1.0
Cr 0.05-0.25
Si max. 0.40
Fe max. 0.40
Cu max. 0.10
Zn max. 0.25
Ti max. 0.15
impurities each element <0.05, total <0.15,
balance aluminum.

The nominal composition for the AA5083 alloy is about 4.4 wt. % Mg, 0.7 wt. % Mn and 0.15 wt. % Cr.

The compositional ranges for AA5456 are, in weight percent:

Mg 4.7-5.5
Mn 0.50-1.0
Cr 0.05-0.20
Si max. 0.25
Fe max. 0.40
Cu max. 0.10
Zn max. 0.25
Ti max. 0.20
impurities each element <0.05, total <0.15,
balance aluminum.

The nominal composition for the AA5456 alloy is about 5.0 wt. % Mg, 0.7 wt. % Mn and 0.15 wt. % Cr.

The compositional ranges for AA7039 are, in weight percent:

Zn 3.5-4.5
Mg 2.3-3.3
Mn 0.10-0.40
Cr 0.15-0.25
Si max. 0.30
Fe max. 0.40
Cu max. 0.10
Ti max. 0.10
impurities each element <0.05, total <0.15,
balance aluminum.

The nominal composition for the AA7039 alloy is about 4 wt. % Zn, 2.8 wt. % Mg, 0.25 wt. % Mn and 0.20 wt. % Cr.

Unless otherwise indicated, all composition percents in the present specification are weight percents.

The most important requirements for aluminum alloy armour plate are resistance to projectiles, good corrosion resistance and stress corrosion resistance in particular, and in modern applications, good weldability. Ballistic tests are often conducted with armour-piercing projectiles such as 0.30 inch calibre projectiles and with fragment-simulating projectiles such as the common 20 mm projectile. Aluminum alloys which satisfy all the requirements for armour plate are desirable.

Another aluminum-magnesium alloy is the AA5059 alloy registered with the Aluminum Association in June 1999. The registered compositional ranges for AA5059 are, in weight percent:

Mg 5.0-6.0
Mn 0.6-1.2
Zn 0.40-0.9
Zr 0.05-0.25
Cr max. 0.25
Si max. 0.45
Fe max. 0.50
Cu max. 0.25
Ti max. 0.20
impurities each element <0.05, total <0.15,
balance aluminum.

This aluminum alloy is also disclosed in U.S. Pat. No. 6,238,495-B2 and U.S. Pat. No. 6,342,113-B2, both incorporated herein by reference in their entireties. The aluminum alloy is for the construction of large welded structures such as storage containers and vessels for marine and land transportation. The alloy has found in particular commercial usage in shipbuilding application, whereby the aluminum alloy is typically in the H321-temper or 0-temper and has a thickness or gauge of less than 20 mm. According to U.S. Pat. No. 6,238,495 the H321 temper was reached by a cold rolling reduction of 40% followed by heat treating by soaking the cold rolled product at 250° C. for one hour. The 0-temper was reached by a cold rolling reduction of 40% followed by soaking to cold rolled product at 525° C. for a period of 15 minutes.

SUMMARY OF THE INVENTION

An object of the present invention is to provide an improved 5000 series alloy that has very good weldablility, yet exhibits good corrosion performance and high resistance to incoming kinetic energy projectiles.

A further object is to provide a 5000 series alloy product having at least similar ballistic properties as its AA5083-H131 counterpart but with a higher elongation at fracture.

These and other objects and further advantages are met or exceeded by the present invention concerning an aluminum alloy plate having improved resistance against incoming kinetic energy projectiles, the plate having a gauge of 10 mm or more and the aluminum alloy having a chemical composition comprising, in weight percent:

Mg about 4.0-6.0, preferably about 4.3-5.7

Mn about 0.2 to 1.4, preferably about 0.4-1.2

Zn max. 0.9, preferably about 0.20-0.90, preferably about 0.35-0.70

Zr<0.3, preferably about 0.05-0.25

Cr<0.3

Sc<0.5

Ti<0.3

Fe<0.5, preferably <0.25

Si<0.45, preferably <0.2

Ag<0.4

Cu<0.25 other elements and unavoidable impurities each <0.05, total <0.20, balance aluminum, and wherein the alloy plate is obtained by a manufacturing process comprising casting, preheating and/or homogenisation, hot rolling, a first cold working operation, an annealing treatment at a temperature of less than 350° C., followed by a second cold working operation.

In an embodiment the plate has an at least 4% improvement, and preferably an at least 5% improvement, in the V50 limit compared to an AA5083-H131 counterpart, as measured by the 30 AMP2 test according to MIL-DTL-46027J of September 1998.

By an AA5083-H131 counterpart it is meant an aluminum alloy plate having a composition as defined above for AA5083, and processed and heat treated to H131 temper and having the same dimensions of length, width and thickness as the plate of the present invention to which it is compared. A typical counterpart has a composition within the elemental window of about 4.4 wt. % Mg, 0.7 wt. % Mn, 0.15 wt. % Cr, 0.40 wt. % Si max., 0.40 wt. % Fe max., 0.10 wt. % Cu max., 0.25 wt. % Zn max., 0.15 wt. % Ti max., impurities each element <0.05 wt. %, total <0.15 wt. %, and balance aluminum. A typical processing route for obtaining an H131 temper is by means of casting an ingot of defined composition, homogenisation and/or preheat prior to hot rolling, hot rolling to intermediate gauge, cold rolling to final gauge using a cold rolling deformation of about 15 to 25%, followed by a stretching operation of maximum 1.5% to achieve flatness and straightness requirements. No annealing is carried out subsequently to any of the cold rolling or stretching steps. A plate within the elemental composition and processed as described for the present invention having the at least 4% improvement in the V50 limit over a single AA5083-H131 counterpart meets the feature of being a plate having an at least 4% improvement in the V50 limit compared to an AA5083-H131 counterpart. For example, a plate within the elemental composition described for the present invention having the at least 4% improvement in the V50 limit over an AA5083-H131 counterpart, having a composition of 4.4 wt. % Mg, 0.7 wt. % Mn, 0.15 wt. % Cr, 0.2 wt. % Si, 0.2 wt. % Fe, 0.05 wt. % Cu, 0.15 wt. % Zn, 0.1 wt. % Ti, impurities each element <0.05 wt. %, total <0.15 wt. %, and balance aluminum, meets the feature of being a plate having an at least 4% improvement in the V50 limit compared to an AA5083-H131 counterpart.

Likewise, an AA7039-T6 counterpart is an aluminum alloy plate having a composition as defined above for AA7039 and processed and heat treated to a T6 temper and having the same dimensions of length, width and thickness as the plate of the present invention to which it is compared. A typical counterpart has a composition within the elemental window of about 4 wt. % Zn, 2.8 wt. % Mg, 0.25 wt. % Mn and 0.20 wt. % Cr, 0.30 wt. % Si max., 0.40 wt. % Fe max., 0.10 wt. % Cu max., 0.10 wt. % Ti max., impurities each element <0.05 wt. %, total <0.15 wt. %, balance aluminum; for example, 4 wt. % Zn, 2.8 wt. % Mg, 0.25 wt. % Mn and 0.20 wt. % Cr, 0.20 wt. % Si, 0.20 wt. % Fe, 0.05 wt. % Cu, 0.05 wt. % Ti, impurities each element <0.05 wt. %, total <0.15 wt. %, balance aluminum.

The armour plate is useful, for example, in military and/or anti-terrorist applications to protect authorized law enforcement and/or military personnel. For example, authorized law enforcement and/or military personnel patrolling areas containing known or suspected terrorists could do so while in vehicles armoured with the present armour plate.

DETAILED DESCRIPTION OF THE PREFERRED EMBODIMENTS

Figure 1:
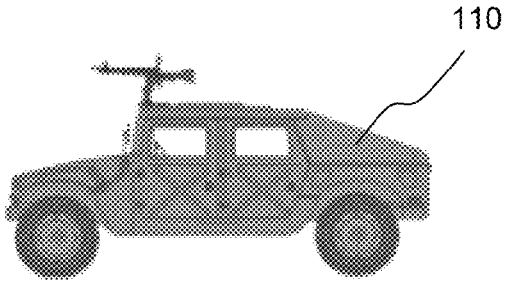
FIG. 1 shows an up-armoured Multipurpose Wheeled Vehicle, or "HMMWV".

The present invention provides an aluminum alloy plate having improved resistance against incoming kinetic energy projectiles, the plate having a gauge of 10 mm or more and the aluminum alloy having a chemical composition comprising, in weight percent:

Mg about 4.0-6.0, preferably about 4.3-5.7, for example 4.9-5.6

Mn about 0.2 to 1.4, preferably about 0.4-1.2, for example 0.65-0.9

Zn about 0.9 max., preferably about 0.20-0.90, preferably about 0.35-0.70, for example 0.45 to 0.6

Zr<0.3, preferably about 0.05-0.25, for example about 0.05-0.15

Cr<0.3, for example about 0.08 to 0.15

Sc≤0.5, for example about 0.08 to 0.45, 0.2 to 0.45, or <0.1, but preferably 0.05 to 0.30, 0.05 to 0.20, or 0.05 to 0.15

Ti≤0.3, for example <0.1

Fe<0.5, preferably <0.25, for example <0.14

Si<0.45, preferably <0.2, for example <0.14

Ag<0.4, for example <0.01

Cu<0.25, for example <0.05, other elements and unavoidable impurities each <0.05, total <0.20, balance aluminum, and and wherein the alloy plate is obtained by a manufacturing process comprising casting, preheating and/or homogenisation, hot rolling, a first cold working operation, an annealing treatment at a temperature of less than 350° C., followed by a second cold working operation.

In an embodiment the plate has an at least 4%, and preferably an at least 5%, improvement in the V50 limit compared to an AA5083-H131 counterpart, as measured by the 30 AMP2 test according to MIL-DTL-46027J of September 1998. This improvement is particularly pronounced for the alloy plate products having 4.9% Mg of more.

In an embodiment the plate has an at least 4% improvement, and preferably an at least 6% improvement, in the V50 limit compared to an AA5083-H131 counterpart, as measured by the 20 mm FSP test according to MIL-DTL-46027J of September 1998. This improvement is particularly pronounced for the alloy plate products having 4.9% Mg of more.

The aluminum alloy plate according to the present invention offers a plate product ideally suitable for armour plate applications having at least similar ballistic properties, and in the best examples even significantly improved ballistic properties, compared to its AA5083-H131 counterpart in combination with improved formability expressed in elongation at fracture.

The aluminum alloy plate according to the present invention offers also a plate product having ballistic properties close to its AA7039-T6 counterpart, but in combination with very good weldability and improved corrosion resistance performance, in particular in stress corrosion resistance, compared to the AA7039-T6 alloy. This combination of ballistic properties, very good weldability and corrosion resistance performance favours the alloy plate of the present invention for the application as armour plate.

An important advantage of the present invention is the improved Mass Efficiency compared to AA5083-H131 and even compared to AA7039-T6 counterparts. The alloy product according to the invention has a lower specific density measured at 20° C. compared to both the AA5083 and AA7039 alloys resulting in a favourable strength-to-weight ratio or specific strength (tensile strength divided by specific density). This improvement is particularly pronounced for the alloy plate products having 4.9% Mg of more. The Mass Efficiency is a measure for the FSP performance and relates also to the specific density and allows for a fair comparison of various armour plate materials of similar gauge against each other. Mass Efficiency or "$E_m$" is being defined as the weight per unit area of a reference material, for example an AA 5083-H131 counterpart alloy, required for defeating a given ballistic threat divided by the weight per unit area of the subject material.

It has been found that when taking AA5083-H131 as the norm, then the AA7039-T64 shows a more than 3% better Mass Efficiency, whereas the alloy product according to this invention shows a more than 5% improvement, and in the better examples an at least 7% improvement. The improvement found increased even further as the higher velocity of the impacting projectile was increased. The improved mass efficiency of the alloy product allows for the construction of a lighter vehicle while offering the same resistance against incoming projectiles. Weight saving in an armoured vehicle can translate amongst other advantages, into vehicle mobility. Alternatively, when constructing an armoured vehicle an unchanged plate thickness can be used while offering a significantly improved resistance against incoming projectiles and thereby an increased survivability.

In the alloy product according to this invention Mg content is limited to 6% because alloy products having a higher Mg content are not very easy to manufacture. Furthermore, a Mg content of more than 6% does not result in any significant strength increase, whereas the corrosion resistance, in particular the resistance against intergranular corrosion, exfoliation corrosion and stress corrosion, deteriorate very fast at higher Mg levels. The Mg content should be more than 4.0% in order to provide amongst others a sufficient strength levels for the preferred applications of the alloy plate for armour plate applications. More preferably the Mg content is at least 4.3%, and more preferably at least 4.9%. If desired Mg+Mn is greater than 6.8% or Mg+Mn is less than 5.9%.

The plate product preferably has a Zn content in a range of about 0.2 to 0.9 wt. % to enhance weldability and the corrosion resistance of the base plate.

The plate product preferably has a Zr content in a range of about 0.05 to 0.25%, for example >0.16 to 0.25 wt. %, to further improve the weldability and the corrosion resistance of the base plate.

Ti may be purposively added up to about 0.3 wt. %, for example >0.16 to 0.3 wt. %, for grain-refiner purposes during casting and/or welding.

If desired Cr and/or Ti may be absent. However, in another embodiment a further improvement of the properties, particularly the corrosion resistance, of the aluminum alloy plate product according to the invention is obtained when both Ti and Cr are present in considerable amounts within the defined range. Preferably titanium and chromium are present in equal or about equal quantities in the aluminum alloy product, and wherein Cr is in a range of about 0.08 to 0.25 wt. % and Ti is a range of about 0.1 to 0.2 wt. %. In this embodiment also Zr in the previously defined range of 0.05 to 0.25 wt. % may be present in addition to the combined presence of Ti and Cr in the defined ranges.

It has been found that for a given alloy composition with a combined addition of Cr and Ti the strength increases while the toughness is maintained at about the same level.

In an embodiment Sc may purposively be added up to 0.5 wt. %, preferably in a range of 0.05 to 0.3 wt. %, and more preferably in the range of 0.05 to 0.15 wt. %, to further increase the resistance to incoming kinetic energy projectiles.

In a preferred embodiment the aluminum alloy plate according to the present invention has a composition within the range of AA5059.

In an embodiment the alloy plate has a proof strength ("PS") of at least about 250 MPa, preferably at least about 255 MPa, and more preferably at least about 260 MPa, when measured in its L-direction.

In an embodiment the alloy plate has a ultimate tensile strength ("UTS") of at least about 320 MPa, preferably at least about 330 MPa, and more preferably at least about 340 MPa, when measured in either in its L-direction or LT direction.

In an embodiment the alloy plate has an elongation to fracture measured in a tensile test according to ASTM B557 in the L-direction of more than 10%, and preferably of more than 12%. In a further embodiment the elongation in the LT-direction is 13% or more, and in the best examples of 14% or more. These values offer an improved formability such that the plate product can be formed, for example by means of bending, prior to welding. These elongation values are higher compared to an AA5083-H131 plate of similar thickness.

The plate according to this invention is ideally suitable as armour plate for application in armoured vehicles, in particular armoured military vehicles. The gauge range or thickness range of the aluminum alloy plate is of more than about 10 mm. A suitable upper-limit for aluminum alloy plate is about 100 mm. A preferred gauge range is of about 15 to 75 mm, and more preferably in a range of about 25 to 75 mm.

In a more preferred embodiment of the manufacturing process of the alloy plate, the alloy plate at final gauge after the cold working operation is not subjected to of a further heat-treatment such that no substantial recovery occurs in the alloy plate. This results in the mechanical properties at final thickness or final gauge remaining substantially unchanged, thus substantially no recovery occurs. After a cold working operation according to the present invention a heat-treatment of for example 30 min at 80° C. can be carried out as this merely stabilises the alloy product. Whereas a heat treatment of 30 min or 60 min at 250° C. to obtain an H321 temper results amongst others in an undesirable increase of the ductility. Any high temperature heat-treatment after cold working to final thickness is preferably to be avoided.

The alloy described herein can be ingot derived and can be provided as an ingot or slab by casting techniques including those currently employed in the art. A preferred practice is semi-continuous casting of large ingots, for instance 350 or 600 mm in thickness by about 1000 mm or more in width by about 3.5 m or more in length. Such large ingots are preferred in practicing the invention especially in making large plate products for use in armour plate applications.

The aluminum alloy stock is preferably preheated or homogenized at a temperature of at least 480° C. prior to hot rolling in single or multiple steps. In order to avoid eutectic melting resulting in possible undesirable pore formation within the ingot the temperature should not be too high, and should typically not exceed 535° C. The time at temperature for a large commercial ingot can be about 2 to 24 hours. A longer period, for example 48 hours or more, has no immediate adverse effect on the desired properties, but is economically unattractive. When using regular industrial scale furnace the heating rate is typically in a range of 30 to 40° C./hour.

The alloy is hot rolled to reduce its thickness by at least about 30% of its initial (before any hot rolling) thickness, preferably by about 50% or more, for instance 60 or 65% or more of its thickness when using large commercial starting stock (for instance around 400 mm or more thick) using a reversing hot mill which rolls the metal back and forth to squeeze its thickness down. Thus, the initial hot rolling can be done in increments using different rolling mills. It can also include conventional reheating procedures at around 500° C. or so between the rolling passes to replace lost heat.

Following the hot rolling operation the alloy product is cold worked by means of a first cold working operation selected from the group consisting of (i) stretching in a range of 2 to 15%, and (ii) cold rolling with a cold roll reduction in a range of 4% to less than 45%.

Following the first cold working operation there is a second cold working operation selected from the group consisting of (i) stretching in a range of about 2 to 15%, and (ii) cold rolling with a cold roll reduction in a range of about 4% to less than 25%.

Between the first and second cold working operation the plate is subjected to an annealing treatment at a temperature of less than 350° C. appropriate to enhance workability, preferably at a temperature of 300° C. or less, and more preferably in a temperature range of about 220° C. to 300° C. The soaking temperature for the annealing treatment would typically be in the range of 10 minutes to 10 hours.

It has been found that if only one cold working operation is carried out without any annealing treatment would result either in a too low strength and reduced ballistic properties or a very low formability.

In a preferred embodiment the cold stretching in the first and second cold working operation consists of a stretch in a range of about 4 to 15%, and preferably in a range of about 4 to 10%.

Stretching is defined as the permanent elongation in the direction of stretching, commonly in the L-direction of the plate product. The stretching operation is preferably carried out when producing thicker gauge plate products, such as for plate products having a final gauge of 25 mm or more, and preferably of 38 mm or more. It has been found that a cold stretching operation allows for more uniform properties over the thickness of the plate compared to a cold rolling operation.

The cold working steps can also be carried out in combination, although in a less preferred mode, for example by carrying out a 10% cold rolling operation followed by an 8% stretching operation.

The aluminum alloy plate product according to the invention can be welded by means of all regular welding techniques such as MIG and friction stir welding. After the welding operation there is no need for further heat treatment to obtain maximum properties or to recover some of the losses in mechanical properties as a resultant of the heat input during the welding operation and therefore there are less costs in the production of armoured vehicles. The aluminum plate can be welded using regular filler wires such as AA5183 or by modified filler wires having a higher Mg- and/or Mn-content.

A further aspect of the invention relates to a method of use of the aluminum alloy product as armour plate in an armoured vehicle, in particular in military vehicles such as Tracked Combat Systems, Armoured Personnel Carriers, Armoured Support Systems, Amphibious Assault Systems, Advanced Assault Amphibious Vehicles or Armed Robotic Vehicles. When applied in such armoured vehicles it will be a form of a welded configuration such that it forms integral armour. Hang-on armour plate is possible for the aluminum alloy plate according to this invention, but is not the most preferred application.

Figure 2:
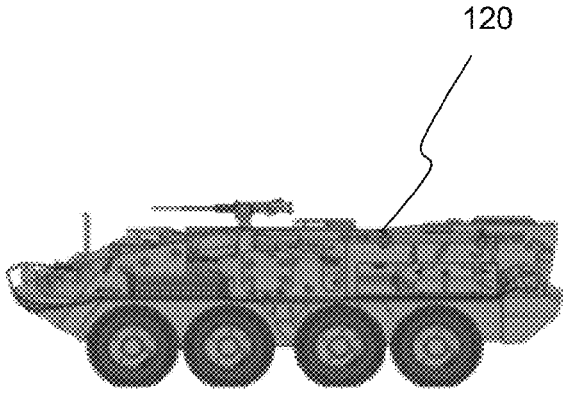
FIG. 2 shows a Stryker vehicle.
Figure 3:
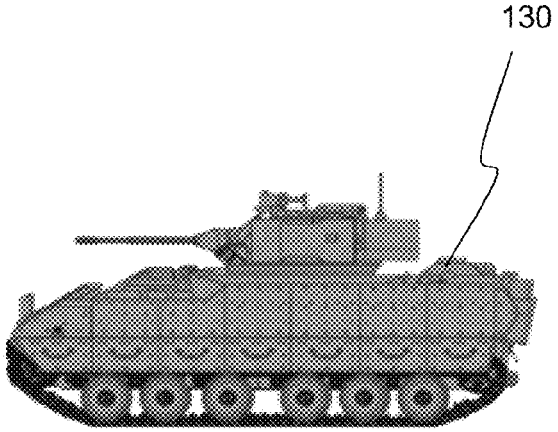
FIG. 3 shows a Bradley M2/M3 vehicle.

FIG. 1 shows an up-armored US Army High Mobility Multipurpose Wheeled Vehicle, or "HMMWV" 110. FIG. 2 shows a Stryker vehicle 120. FIG. 3 shows a Bradley M2/M3 vehicle 120. These vehicles 110, 120, 130 can be modified in view of the present invention to have plates of the armour of the present invention applied, for example by welding, to an outer surface or other locations of the vehicle suitable for armour protection. The armour is vital protection against small arms, rocket-propelled grenades, or RPGs, and "improvised explosive devices," or IEDs. Additional information on armored vehicles is available at the website of Global Security.org, Alexandria, Va., http://www.globalsecurity.org/military/systems/ground/hmmwvua.htm, July 2006.

The invention will now be illustrated with reference to non-limiting embodiments according to the invention.

EXAMPLES

Example 1

On an industrial scale by means of DC-casting several ingots of 400 mm thickness have been cast having a composition within the range of AA5059, namely, in weight percent: 5.45% Mg, 0.81% Mn, 0.51% Zn, 0.14% Zr, 0.09% Si, 0.08% Fe, 0.03% Ti, balance aluminum and unavoidable impurities. The ingots have been scalped, then preheated for 8 hours at 510° C., then hot rolled to a gauge of 28 to 57 mm, and then cold stretched for 6% as a first cold working operation, then annealed with about 15 minutes soak at about 250° C., and then cold stretched about 6% or subjected to a cold rolling reduction of about 7% as a second cold working operation resulting in the final plate thickness. The hot rolling practice was such that the cold working reduction could be varied to investigate the mechanical properties as function of the final plate thickness. The cold worked plates received no further heat-treatment after the last cold working operation.

The mechanical properties (tensile strength and ultimate tensile strength) have been measured according to ASTM B557 in the LT direction and the L-direction. The mechanical properties are listed in Table 1.

TABLE 1

Mechanical properties of Proof Strength and Ultimate Tensile Strength in the T-L and L-direction as function of the amount of thickness.

| | L-direction | | | LT-direction | | |
|---|---|---|---|---|---|---|
| thickness (mm) | PS (MPa) | UTS (MPa) | A (%) | PS (MPa) | UTS (MPa) | A (%) |
| 25.4 | 320 | 376 | 12 | 277 | 370 | 16 |
| 38.8 | 309 | 387 | 11.3 | 262 | 374 | 16.6 |
| 50.8 | 305 | 361 | 14 | 266 | 362 | 15 |

From the results of Table 1 it can be seen that the mechanical property levels of the alloy product when manufactured according to this invention has a combination of significantly higher properties and elongation compared to an AA5083-H131 counterpart. Typical elongation for the AA5085-H131 of similar thickness are about 9% in the L-direction together a Proof Strength of 255 MPa and an Ultimate Tensile Strength of 310 MPa, and about 9.5% in the LT-direction and a Proof strength of 256 MPa and an Ultimate Tensile Strength of 311 MPa.

Example 2

This example relates to aluminum alloy plate of 38.8 mm gauge according to this invention, in particular the preferred embodiment of the AA5059 alloy manufactured according to the process and chemical composition of Example 1. The plate was tested for its ballistic properties and compared against its armour plate counterpart AA5083-H131.

Two ballistic tests have been carried out, namely an armour piercing test using 0.3 inch (6.72 mm) projectiles pursuant to MIL-DTL-46027J of September 1998, and with 20 mm fragment simulating projectiles pursuant to MIL-DTL-46027J of September 1998. In both tests the V50 limit in m/s is determined. The V50 limit or v50 value is defined as the arithmetic mean of the 2(3) lowest projectile velocities giving complete penetration and the 2(3) highest velocities giving partial penetration. "2(3)" means two out of three. These velocities should fall within a bracket of 18.3 (27.4) m/s (MIL-DTL-46027J(MR)). The results are listed in Table 2.

TABLE 2

The V50 limit (in m/s) of the AA5059 alloy processed according to the invention versus the standard AA5083-H131.

| | 0.3 APM2 | | | 20 mm FSP | | |
|---|---|---|---|---|---|---|
| thickness | AA 5083- | AA5059 | | AA 5083- | AA5059 | |
| (mm) | H131 | measured | improvement | H131 | measured | improvement |
| 38 | 716 | 750 | 5.1% | 724 | 757 | 4.5% |

From the results of Table 2 it can be seen that the plate product according to this invention exhibits in both type of tests ballistic properties which are better compared to its AA5083-H131 counterpart. In combination with the higher elongation at fracture as illustrated in Example 1 above making the alloy plate according to this invention a very attractive candidate for armour plate applications.

Having now fully described the invention, it will be apparent to one of ordinary skill in the art that many changes and modifications can be made without departing from the spirit or scope of the invention as herein described.

The invention claimed is:

1. A method of manufacturing an aluminium alloy plate having improved resistance against incoming kinetic energy projectiles, the plate having a final gauge of 10 mm or more, the method comprising the following steps:

(a) casting an aluminum alloy having a chemical composition comprising, in weight percent:

Mg 4.0 to 6.0
Mn 0.2 to 1.4
Zn 0.9 max.
Zr<0.3
Cr<0.3
Sc≤0.5
Ti≤0.3
Fe<0.5
Si<0.45
Ag<0.4
Cu<0.25, other elements and unavoidable impurities each <0.05, total <0.20, balance aluminum, (b) preheating and/or homogenisation, (c) hot rolling, (d) a first cold working operation selected from the group consisting of stretching in the range of 2 to 15% and cold rolling with a cold rolling reduction of 4 to 12%, (e) an annealing treatment at a temperature of less than 350° C., followed by (f) a second cold working operation consisting of stretching in a range of 2 to 15%, and wherein the manufacturing process of the alloy plate at final gauge after the cold working operation is devoid of a further heat treatment, such that no substantial recovery occurs in the alloy plate.

2. The method according to claim 1, wherein the aluminum alloy plate has an at least 4 improvement in the V50 limit compared to an AA5083-H131 counterpart, as measured by the 30 AMP2 test according to MIL-DTL-46027J of September 1998.

3. The method according to claim 1, wherein the aluminum alloy plate has a proof strength of at least 255 MPa.

4. The method according to claim 1, wherein the aluminum alloy plate has an ultimate tensile strength of at least 330 MPa.

5. The method according to claim 1, wherein the aluminum alloy plate has an elongation in the L-direction of more than 10%.

6. The method according to claim 1, wherein the aluminum alloy plate has an elongation in the LT-direction of more than 13%.

7. The method according to claim 1, wherein the Mg content in the aluminum alloy plate is 4.9% or more.

8. The method according to claim 1, wherein the Mg content in the aluminum alloy plate is in a range of 5.0 to 5.6%.

9. The method according to claim 1, wherein the Mn content in the aluminum alloy plate is in a range of 0.4 to 1.2%.

10. The method according to claim 1, wherein the Mn content in the aluminum alloy plate is in a range of 0.65 to 1.2%.

11. The method according to claim 1, wherein in the aluminum alloy plate the Mg+Mn>6.8% or Mg+Mn<5.9%.

12. The method according to claim 1, wherein the Zn content in the aluminum alloy plate is in a range of 0.20 to 0.90%.

13. The method according to claim 1, wherein the Zn content in the aluminum alloy plate is in a range of 0.35 to 0.70%.

14. The method according to claim 1, wherein the Zr content in the aluminum alloy plate is in a range of 0.05 to 0.25.

15. The method according to claim 1, wherein the Cr content in the aluminum alloy plate is in a range of 0.08 to 0.25% and the Ti content is in a range of 0.1 to 0.2%.

16. The method according to claim 1, wherein the chemical composition of the aluminum alloy plate is within the range of AA5059.

17. The method according to claim 1, wherein the aluminum alloy plate has a gauge of less than 100 mm.

18. The method according to claim 1, wherein the aluminum alloy plate has a gauge in the range of 15 to 75 mm.

19. The method according to claim 1, wherein the aluminum alloy plate has a gauge in the range of 25 to 75 mm.

20. The method according to claim 1, wherein the first cold working operation consists of stretching in a range of 4 to 10%.

21. The method according to claim 1, wherein the second cold working operation consists of stretching in a range of 4 to 10%.

22. The method according to claim 1, wherein the first cold working operation consists of stretching in a range of 4 to 10% and the second cold working operation consists of stretching in a range of 4 to 10%; wherein the Zn content in the aluminium alloy plate is in a range of 0.35 to 0.70%.

23. The method according to claim 1, wherein the annealing treatment is carried out at a temperature in a range of less than 300° C.

24. The method according to claim 1, wherein the annealing treatment is carried out at a temperature in a range of 220° C. to 300° C.

* * * * *